US006717364B1

(12) United States Patent
Zhu et al.

(10) Patent No.: US 6,717,364 B1
(45) Date of Patent: Apr. 6, 2004

(54) THALLIUM FREE—METAL HALIDE LAMP WITH MAGNESIUM HALIDE FILLING FOR IMPROVED DIMMING PROPERTIES

(75) Inventors: Huiling Zhu, Lexington, MA (US); Jakob Maya, Brookline, MA (US)

(73) Assignee: Matsushita Research & Development Labs Inc, Woburn, MA (US)

( * ) Notice: Subject to any disclaimer, the term of this patent is extended or adjusted under 35 U.S.C. 154(b) by 225 days.

(21) Appl. No.: 09/627,841

(22) Filed: Jul. 28, 2000

(51) Int. Cl.[7] ..... H01J 17/20
(52) U.S. Cl. ..... 313/642; 313/641
(58) Field of Search ..... 313/642, 640, 313/638, 643, 571, 572, 25

(56) References Cited

U.S. PATENT DOCUMENTS

| | | | | | |
|---|---|---|---|---|---|
| 3,867,665 | A | * | 2/1975 | Furmidge et al. | 313/485 |
| 4,745,335 | A | * | 5/1988 | Ohyama et al. | |
| 4,769,576 | A | * | 9/1988 | Ohyama et al. | 313/638 |
| 5,394,059 | A | * | 2/1995 | Ohyama et al. | 313/639 |
| 5,698,948 | A | * | 12/1997 | Caruso | 313/637 |
| 6,242,851 | B1 | * | 6/2001 | Zhu et al. | 313/25 |

* cited by examiner

*Primary Examiner*—Ashok Patel

(57) ABSTRACT

A [thallium free] high pressure ceramic metal halide lamp having superior dimming characteristics with a fill composition including $MgI_2$ and/or $MgBr_2$.

2 Claims, 4 Drawing Sheets

THALLIUM FREE— METAL HALIDE LAMP WITH MAGNESIUM HALIDE FILLING FOR IMPROVED DIMMING PROPERTIES

TECHNICAL FIELD

This invention relates to high intensity discharge lamps and more particularly to high intensity discharge metal halide lamps. Still more particularly it relates to a metal halide filling for ceramic metal halide lamps. Ceramic metal halide lamps usually contain TlI and NaI in their filling. However, other known metal halide materials such as $DyI_3$, $HoI_3$, and $TmI_3$ are frequently used.

BACKGROUND OF THE INVENTION

This invention relates generally to high intensity discharge (HID) lamps and, more particularly, to metal halide lamps with ceramic discharge vessels having superior dimming characteristics. Low wattage metal halide lamps with their high efficacy have become widely used for interior lighting. Until now, almost all metal halide lamps were used for general lighting and have been operated at rated power. Due to the ever-increasing interest in energy conserving lighting systems, some dimmable metal halide ballast systems are available on the market for metal halide lamps. Working under dimmed conditions (usually dimmed to as low as 50% of rated power), the performance of the regular metal halide lamps on the market deteriorate dramatically. Typically the color temperature (CCT) increases significantly, while the color-rendering index (CRI) decreases. And the lamp hue will deteriorate from white to greenish or pinkish depending on the lamp's chemistry. Furthermore the efficacy of the lamp usually decreases significantly.

Under dimming conditions, the light emitted by commercially available metal halide lamps will have very strong green hue, which can be very objectionable for many indoor applications. The strong green hue in the light of dimmed ceramic metal halide lamp is due to the radiation of Tl green lines (535.0 nm). Under dimming conditions, the discharge tube wall temperatures as well as its cold-spot temperature is much lower compared to the temperatures at rated power. At the lower cold-spot temperatures under dimming conditions, the ratio of partial pressure of TlI in the discharge tube is much higher compared to the partial pressures of other metal halides. Under dimming conditions, the relatively higher TlI partial pressure emits relatively stronger green Tl radiation at 535.0 nm. Since the Tl radiation at 535.0 nm is very close to the peak of the human eye sensitivity curve, higher lumen efficacy is achieved at rated power with TlI as one of the filling components in almost all commercial ceramic metal halide lamps.

With the present invention, superior lamp performance under dimming conditions with ceramic discharge vessel was achieved in nitrogen filled outer jackets at relatively high pressure between about 350 and 600 mmHg by a new chemical fill of the ceramic discharge tubes. In the newly invented lamps, $MgI_2$ is used in the discharge tubes to replace the TlI in the fill composition of ceramic metal halide lamps. $MgI_2$ is used to replace the TlI as one of the fill components because Mg has both green radiation for higher efficacy and has a similar vapor pressure variation with temperature as that of the rare earth iodides in the discharge tube dosing.

Due to the similar vapor pressure variation with temperatures, $MgI_2$ partial pressure will drop under dimming conditions proportionally to that of the other rare-earth halides. This leads to a white lamp under dimming rather than the greenish hue of the lamps with TlI.

Also, the relatively higher vapor pressure of $MgI_2$ at rated power results in relatively strong green radiation at 518 nm. Since the Mg radiation at 518.0 nm is very close to the peak of the human eye sensitivity curve, higher lumen efficacy is achieved at rated power with $MgI_2$ as one of the filling components. (Under some circumstances $MgBr^2$ could be substituted for TlI).

Therefore an objective of the present invention is to provide a metal halide lamp that when dimmed to about 50% power retains substantially its white hue.

Another objective of the present invention is to provide a metal halide lamp that when dimmed to about 50% power retains the CCT (correlated color temperature) substantially as in rated power.

Yet another objective of the present invention is to provide a metal halide discharge tube fill formulation that at rated power gives substantially similar performance (including efficacy, CRI, CCT and Duv) as the currently available products on the market.

Another objective of the present invention is to provide a metal halide lamp whose performance does not deteriorate under dimming, and whose outer jacket is filled with a gas at high pressure so that arcing is avoided at the end of life or if the outer jacket leaks during the lamp life.

Still another objective of the present invention is to provide a metal halide lamp that when dimmed to about 50% power its color-rendering index remains above 70.

DESCRIPTION OF RELATED PRIOR ART

Disadvantages of existing metal halide discharge lamps:

1. Existing metal halide lamps are optimized for a rated wattage without consideration of dimming performance.
2. When lamp power is reduced to about 50% of rated value the correlated color temperature increases dramatically often more than 1000° K. This change is not acceptable for most indoor applications.
3. When lamp power is reduced to about 50% of rated value the color rendering index decreases significantly.
4. When lamp power is reduced to about 50% of rated wattage the light radiated by the regular metal halide lamp has a color point, which is far away from the black body line, leading to a nonwhite hue.

There is no known publication on the filling materials of metal halide lamps with the purpose of improving dimming performance of metal halide lamps.

U.S. patent application Ser. No. 09/074,623 filed May 7, 1998 now U.S. Pat. No. 6,242,851 by Zhu et. al. by the same assignee, was filed on an invention of a new metal halide lamp which has significantly better lamp performance under dimming conditions. In that patent application, a lamp has a discharge tube burning in vacuum outer jacket to reduce convection heat loss from the cold-spot of the discharge tube, and a metal heat shield is used on the discharge tube to reduce radiation heat loss from the cold-spot during dimming. The invention shows very good dimming performance due to the fact that the thermal emissivity of the metal shield is much lower than that of a ceramic surface. Also the emissivity of the metal goes down as the temperature drops thereby keeping the cold-spot and vapor pressure of the salts substantially constant. A disadvantage of the invention is that widely used high voltage starting pulses on low wattage metal halide lamps in conjunction with a vacuum jacket may make the lamp susceptible to arcing when discharge tube leaks or slow outer jacket leaks exist.

U.S. Pat. No. 5,698,948 discloses a lamp that contains halides of Mg, Tl and one or several of the elements from the group formed by Sc, Y and Ln. The lamp filling also contains Mg to improve lumen maintenance. The lamp has a disadvantage of strong green hue when dimmed to lower than the rated power, due to the relatively higher vapor pressure of TlI under dimming conditions.

Lamps according to the present invention do not contain TlI in their chemical fill, so there is no hue change due to higher TlI vapor pressure under dimming conditions.

Lamps according to the present invention contain $MgI_2$ as one of the main filling materials. The $MgI_2$ is in a molar quantity between about 5 and 50% of the total molar quantity of the total halides. It replaces TlI for green light emission and to reach the same lumen efficacy as the commercial lamps containing Tl fills. The lamp, according U.S. Pat. No. 5,698,948, contains $MgI_2$ as an addition to the filling ingredients just to improve lumen maintenance during lamp life. Through the addition of Mg to the lamp fill, according to the patent, one can influence the balance of one or several chemical reaction between Sc, Y and Ln with spinel ($MgAl_2O_4$) to such an extent that this balance is already achieved shortly after the beginning of lamp life, after which a further removal of the ingredients Sc, Y and Ln does not take place. Since the Mg addition is for reducing chemical reaction between the filling ingredients and the wall, the quantity of Mg fill is based on the surface area of the inner wall of the discharge vessel.

Since $MgI_2$ fill in the present invention is for light emission and for better lamp performance under dimming conditions, the optimization of the quantities of $MgI_2$ fill are based on the lamp performance under rated power as well as reduced power conditions, rather than the surface area of the discharge vessel.

SUMMARY OF THE INVENTION

It is an object of the invention to provide a metal halide lamp in which a superior color performance is achieved under dimming conditions.

According to the invention, the ionizable filling of the lamp also comprises $MgI_2$ in a molar quantity that lies between 10 and 50% of the total molar quantity of the total halides.

The lamp according to the invention has the advantage that the correlated color temperature of the lamps are hardly changed during a dimming operation, and the luminous efficacy of the lamp is not adversely affected by the new filling at rated power.

Elimination of TlI from the chemical filling has the advantage that the light radiated by the lamp has a color point which lies close to the black body line under both rated power and reduced power all the way to 50%.

The lamp of the present invention has significant advantages over lamps of the prior art during dimming performance. In the earlier patent application, (Zhu et. al., application Ser. No. 09/074,633), a lamp must have an discharge tube burning in vacuum outer jacket to reduce convection heat loss from the cold-spot of the discharge tube, and a metal heat shield is used on the discharge tube to reduce radiation heat loss from the cold-spot during dimming. Since high voltage starting pulses are general used on low wattage metal halide lamps to start the lamps. A lamp with vacuum jacket may make the lamp susceptible to arcing when the discharge tube leaks or a slow outer jacket leak exist. Also the use of the refractory metal heat shield may introduce higher lamp manufacturing cost.

With the lamp of the present invention, the ceramic metal halide lamps with superior dimming characteristics function in a nitrogen filled outer jacket which make the lamps much less susceptible to catastrophic failure during their life.

DESCRIPTION OF PREFERRED EMBODIMENTS

Figure 1:
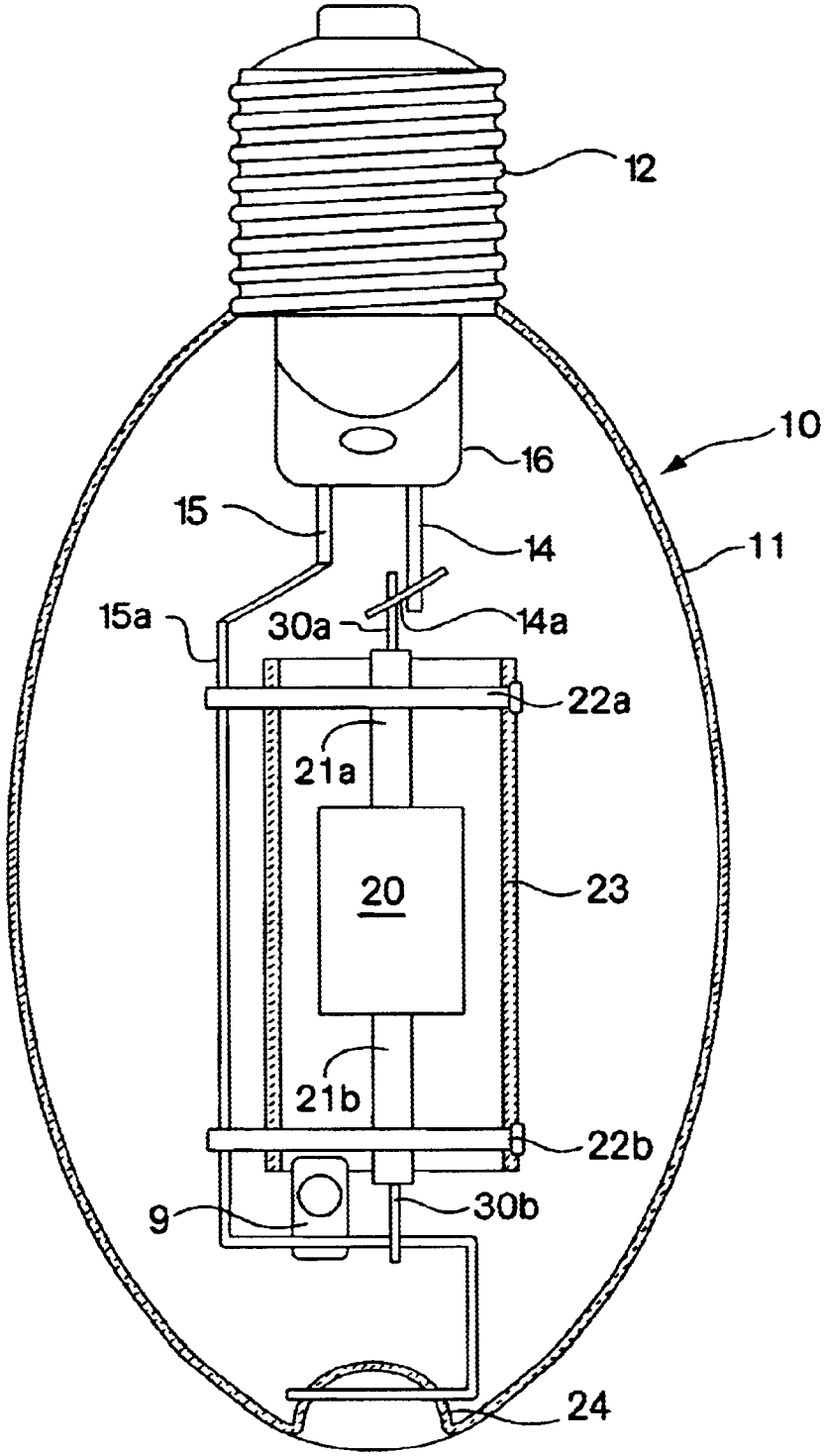
FIG. 1 is an elevation view, partially in cross section, of a ceramic metal halide lamp.

Referring to FIG. 1, the lamp 10 of the present invention includes a bulbous envelope 11 having a conventional base 12 fitted with a standard glass flare 16. Lead-in wires 14 and 15 extend from the base 12 through the flare 16 to the interior of the envelope 11, as is conventional. A harness formed of a bent wire construction 15, 15*a* is disposed within the envelope 11. The harness is anchored within the envelope on dimple 24. The harness 15, 15*a* and a conducting wire 14*a* support a discharge tube 20. The conducting wire 14*a* is welded onto the lead-in wire 14. A pair of straps 22*a*, 22*b* which are attached to harness 15*a* hold a shroud 23 which surrounds the discharge tube 20. A conventional getter 9 is attached to the harness 15*a*. Wires 30*a*, 30*b* supporting electrodes (not shown) are respectively attached to the harness 15*a* and the conducting wire 14*a* to provide power to the lamp and also provide support. Wires 30*a*, 30*b* are disposed within and hermetically sealed to a pair of narrow tubes 21*a*, 21*b*.

Figure 2:
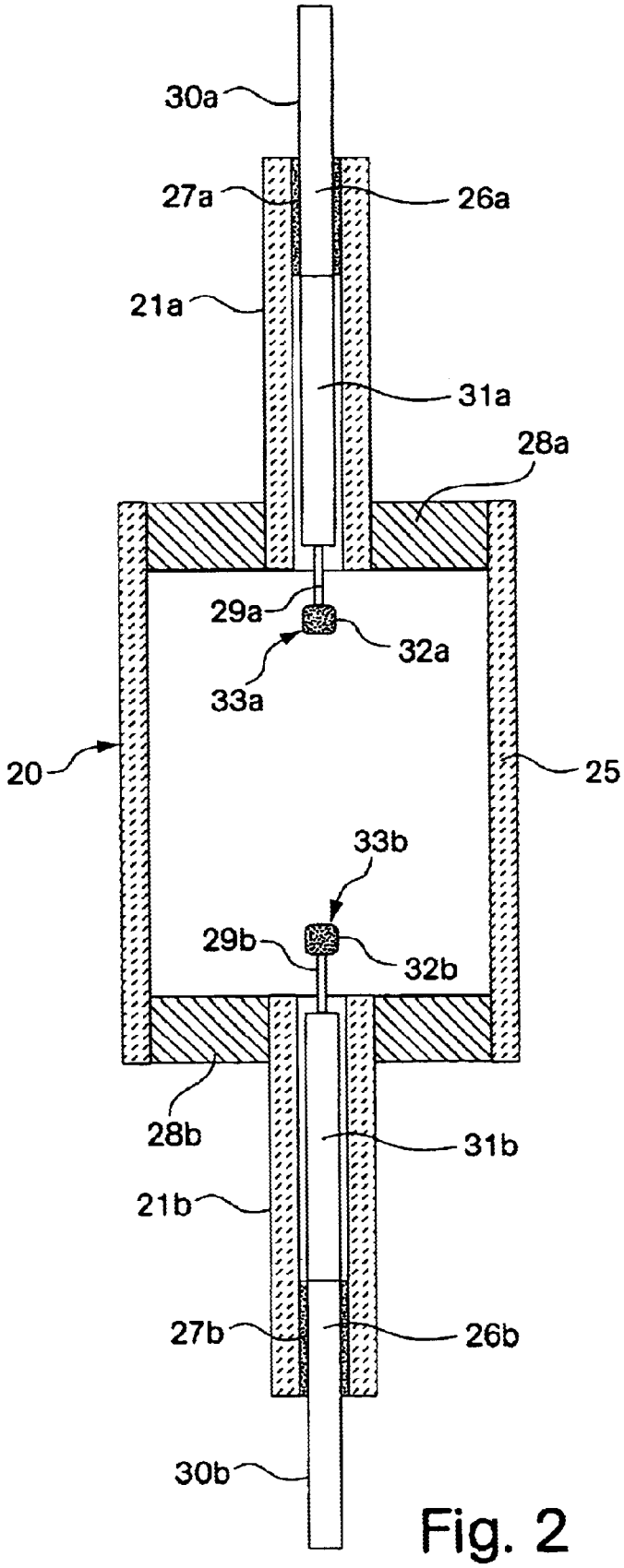
FIG. 2 is an expanded cross-sectional view showing a configuration of a discharge tube in a first embodiment of the present invention.

FIG. 2 is an expanded cross-sectional view showing a configuration of a discharge tube. In FIG. 2, the discharge tube 20 comprises the substantially cylindrical main tube 25, and first and second disks 28*a* and 28*b* disposed at openings of the both ends of the main tube 25, respectively. The main tube 25 and first and second disks 28*a* and 28*b* are made of the translucent ceramic material in which alumina is a main ingredient. The first and second disks 28*a* and 28*b* are integrated and fixed to the main tube 25 by a shrinkage fitting through a sintering process, so that the main tube 25 is sealed airtight.

One end of the cylindrical narrow tube 21*a* is integrated with the first disk 28*a* by the shrinkage fitting. In a similar manner, one end of the cylindrical narrow tube 21*b* is integrated with the second disk 28*b* by the shrinkage fitting. A conductive sealing member 26*a*, a first lead-in wire 31*a* and first main electrode shaft 29*a* are integrated and inserted in the cylindrical narrow tube 21*a*. Specifically, one end of the first lead-in wire 31*a* is connected with one end of the sealing member 26*a* by a welding, and other end of the first lead-in wire 31*a* is connected with one end of the first main electrode shaft 29*a* by the welding. Then, the sealing member 26*a* is fixed to the inner surface of the cylindrical narrow tube 21*a* by a frit 27*a* in a manner that the cylindrical narrow tube 21*a* is sealed airtight. When the sealing member 26*a,* the first lead-in wire 31*a* and first main electrode shaft 29*a* are disposed in the cylindrical narrow tube 21*a,* the other end part of the sealing member 26*a* is led outside the cylindrical narrow tube 21*a,* and serves as the outer lead-in wire 30*a*.

Furthermore, an electrode coil 32*a* is integrated and mounted to the tip portion of the other end of the first main electrode shaft 29*a* by the welding, so the first main electrode 33*a* is configured by the first main electrode shaft 29*a* and the electrode coil 32*a*. The first lead-in wire 31*a* serves as a lead-in part of disposing the first main electrode 33*a* at a predetermined position in the main tube 25. The sealing member 26*a* is formed by a metal wire of niobium. For example, diameter of the sealing member 26*a* is 0.9 mm, and diameter of the first main electrode shaft 29*a* is 0.5 mm.

Similarly, in FIG. 2, a conductive sealing member 26*b,* a first lead-in wire 31*b* and first main electrode shaft 29*b* are integrated and inserted in the cylindrical narrow tube 21*b*. Specifically, one end of the first lead-in wire 31*b* is connected with one end of the sealing member 26*b* by a welding, and other end of the first lead-in wire 31*b* is connected with one end of the first main electrode shaft 29*b* by the welding. Then, the sealing member 26*b* is fixed to the inner surface of the cylindrical narrow tube 21*b* by a frit 27*b* in a manner that the cylindrical narrow tube 21*b* is sealed airtight. When the sealing member 26*b,* the first lead-in wire 31*b* and first main electrode shaft 29*b* are disposed in the cylindrical narrow tube 21*b,* the other end part of the sealing member 26*b* is led outside the cylindrical narrow tube 21*b,* and serves as the outer lead-in wire 30*b*.

Furthermore, an electrode coil 32*b* is integrated and mounted to the tip portion of the other end of the first main electrode shaft 29*b* by the welding, so the first main electrode 33*b* is configured by the first main electrode shaft 29*b* and the electrode coil 32*b*. The first lead-in wire 31*b* serves as a lead-in part of disposing the first main electrode 33*b* at a predetermined position in the main tube 25. The sealing member 26*b* is formed by a metal wire of niobium. For example, the diameter of the sealing member 26*b* is 0.9 mm, and the diameter of the first main electrode shaft 29*b* is 0.5 mm.

In a practical realization of a lamp according to the invention, the discharge vessel is made of polycrystalline alumina. The main electrode shafts and electrode coils are made of tungsten. The lead-in wires of the electrodes are molybdenum. The conductive sealing members of the electrodes are niobium. The rated power of the lamp is 150 W. The filling of the discharge vessel was 10.5 mg Hg and 7.6 mg of the metal halides NaI, $HoI_3$, $TmI_3$ and $MgI_2$ in a molar ratio 42:6:29:23. The total molar quantity of halides of Na, Dy, Ho and Tm is between about 50 and 95%. In addition, the filling comprises Ar or Xe with a filling pressure of 160 mbar as an ignition gas.

FIGS. 3 to 6 show the comparison results of lamps with present invention and a commercial ceramic metal halide lamp. The lamps were operated with a reference ballast and measured in a two meter integrating sphere under IES reference conditions. The data was acquired with a CCD-based computerized data acquisition system. All data presented in FIGS. 3 to 6 were obtained with the operating position of the lamp being vertical base up. The experiments, for which the data is presented in FIGS. 3 to 6, were conducted using 150 W ceramic metal halide discharge tube.

During operation of the lamps according to the present invention, and when comparing them to standard lamps, we found the standard lamps turned greenish on dimming and deviated substantially from the black body locus upon dimming to about 50%. When lamps with chemical fills from this invention were dimmed to about 50%, they still remained substantially on the black body locus, had no greenish hue, and generally looked white. Such color was satisfactory to the eye and it was substantially impossible to discern any color or hue change under dimmed conditions.

Figure 3:
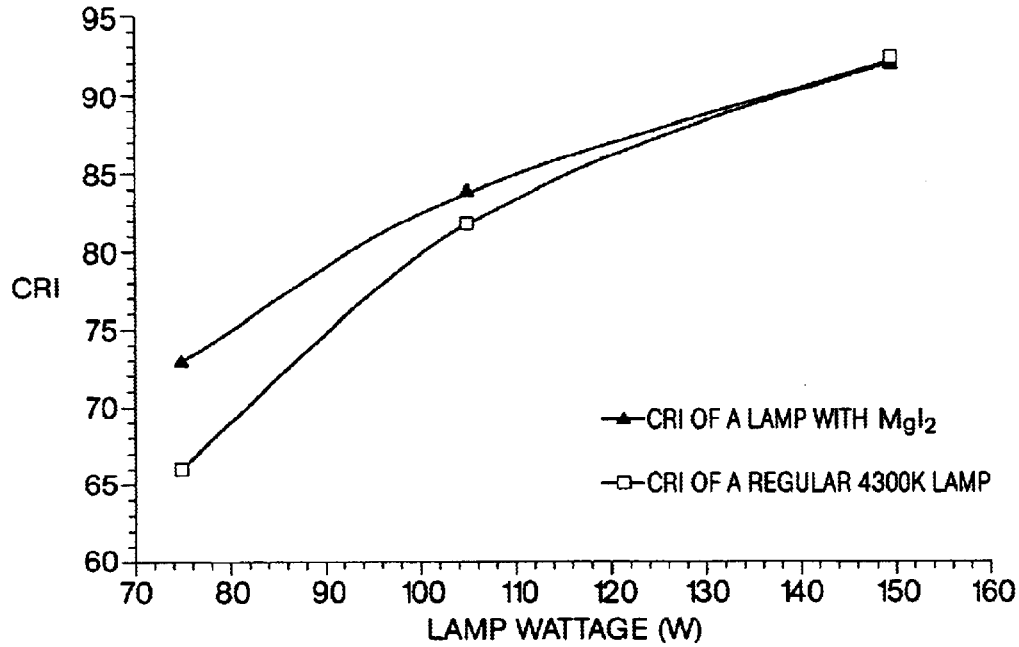
FIG. 3 is a curve showing the color-rendering index (CRI) of a 100-hour photometry measurement of the lamps according to embodiment I and of a prior-art lamp, available on the market.

FIG. 3 shows the changes of color rendering index (CRI) when lamps are dimmed. It can be seen that the CRI of the lamp according to the invention changed less than the standard lamp when the lamp was dimmed to 50% of its rated power.

Figure 4:
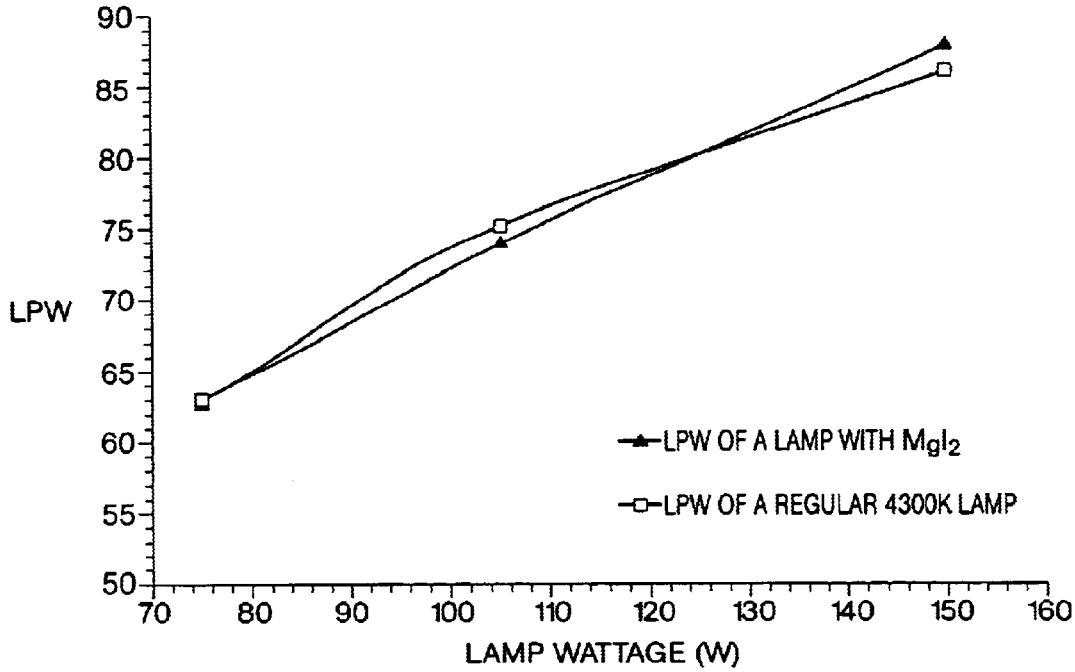
FIG. 4 is a curve showing the lamp efficacy in lumen per watt (LPW) of a 100-hour photometry measurement of the lamps according to embodiment I and of a prior art lamp, available on the market.

FIG. 4 shows the changes of lamp efficacy-lumen per watt (LPW) when lamps are dimmed. It can be seen that the LPW of the lamp according to the invention and the standard lamp changes in a very similar fashion when dimmed to 50% power.

Figure 5:
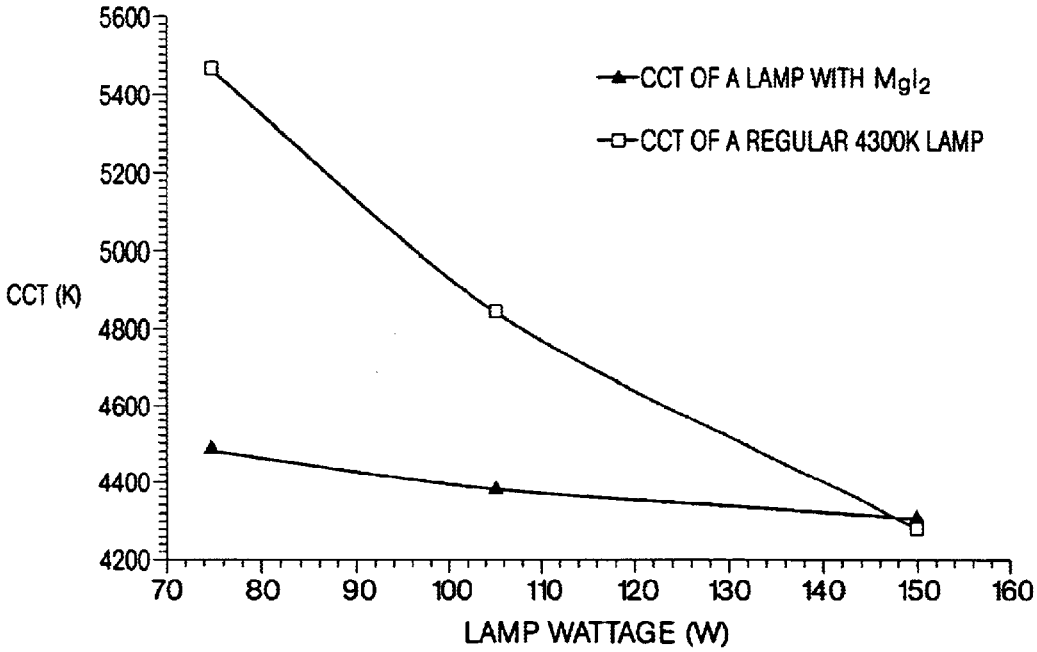
FIG. 5 gives the correlated color temperature (CCT) of a 100-hour photometry measurement of the lamps according to embodiment I and of a prior-art lamp, available on the market.

FIG. 5 shows the changes of correlated color temperature (CCT) when lamps are dimmed. It can be seen that the CCT of the lamp according to the invention did not have significant change when the lamp was dimmed to 50% of its rated power. With the prior art lamp, the CCT change was significant when the lamp was dimmed to 50% of its rated power.

Figure 6:
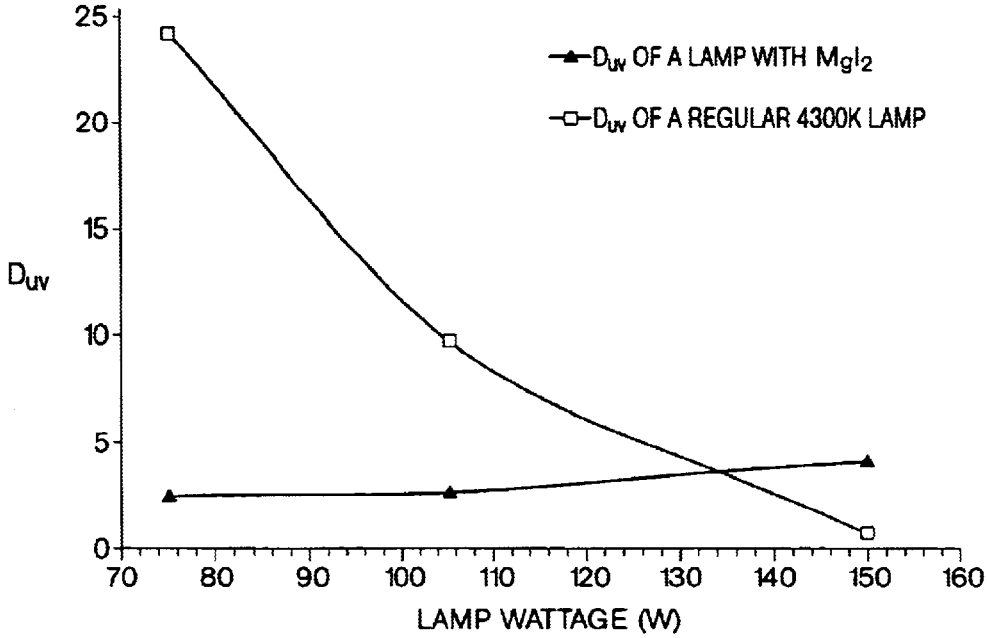
FIG. 6 gives the $D_{uv}$ of a 100-hour photometry measurement of the lamps according to embodiment I and of a prior-art lamp, available on the market.

FIG. 6 shows the changes of lamp $D_{uv}$ when lamps are dimmed. As is well known $D_{uv}$ is a measure of the deviation from the black body. It can be seen that the $D_{uv}$ of the lamp according to the invention did not have significant change when the lamp was dimmed to 50% of its rated power. With the prior art lamp, the $D_{uv}$ change was significant when the lamp was dimmed to 50% of its rated power.

Therefore one can conclude that the lamps according to our formulation, containing $MgI_2$ instead of TlI, perform comparably to the standard lamps at rated power. This performance includes efficacy, CCT, CRI and $D_{uv}$ (which is a measure of how close the light source is to the black body curve). Furthermore, when standard lamps are dimmed to 50% power level their performance deteriorates substantially. What is most disturbing, in this deterioration, from the end user's point of view is the change in CCT and hue which is given by $D_{uv}$. As shown above these problems are eliminated by the substitution of TlI by $MgI_2$ in the present invention. The lamps of the present invention remain at the same CCT and are unchanged in terms of hue remaining white throughout the dimming range.

It is apparent that modifications and changes may be made within the spirit and scope of the present invention, but it is our intention only to be limited by the following claims.

As our invention we claim:

1. A metal halide lamp of different wattage having superior dimming characteristics, said lamp comprising:

a discharge vessel formed of a material resistant to sodium at high temperature;

a fill including mercury and metal halides in said vessel including at least one member selected from the group consisting of $MgI_2$ or $MgBr_2$, wherein the $MPI_2$ or $MgBr_2$ or both are in a molar quantity of the total halides; and a discharge electrode positioned at each opposite end within the discharge vessel; and an envelope surrounding the discharge vessel.

2. A metal halide lamp of different wattage having superior dimming characteristics, said lamp comprising:

a discharge vessel formed of a material resistant to sodium at high temperature;

a fill in said vessel including at least one member selected from the group consisting of $MgI_2$ and/or $MgBr_2$ and an ionizable filling comprising Hg and Ar or Xe, halides of Na and at least one of the halides of Dy, Ho, Tm and wherein the $MgI_2$ is in a molar quantity between about 5 and 50% of the total molar quantity of the total halides; and a discharge electrode positioned at each opposite end within the discharge vessel; and an envelope surrounding the discharge vessel.

* * * * *

UNITED STATES PATENT AND TRADEMARK OFFICE

CERTIFICATE OF CORRECTION

PATENT NO. : 6,717,364 B1
DATED : April 6, 2004
INVENTOR(S) : Zhu et al.

It is certified that error appears in the above-identified patent and that said Letters Patent is hereby corrected as shown below:

Column 6,
Line 62, "$MPI_2$" should be printed -- $MgI_2$ --

Signed and Sealed this

First Day of March, 2005

JON W. DUDAS
*Director of the United States Patent and Trademark Office*